US007621331B2

(12) United States Patent
Mescall et al.

(10) Patent No.: US 7,621,331 B2
(45) Date of Patent: Nov. 24, 2009

(54) FLUID COMMUNICATION NIPPLE HAVING AN INTERIOR PASSAGEWAY WITH AN INTERIOR WALL SECTION THAT MAY BE OPENED TO ESTABLISH FLUID COMMUNICATION WITH THE PASSAGEWAY

(75) Inventors: Stephen Mescall, Kuala Lumpur (MY); Iain Caulfield, Houston, TX (US); Russell A. Johnston, Alvin, TX (US); David E. McCalvin, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 120 days.

(21) Appl. No.: 11/163,230

(22) Filed: Oct. 11, 2005

(65) Prior Publication Data

US 2006/0076136 A1 Apr. 13, 2006
US 2008/0236827 A9 Oct. 2, 2008

Related U.S. Application Data

(63) Continuation-in-part of application No. 10/460,546, filed on Jun. 12, 2003, now Pat. No. 6,973,970.

(60) Provisional application No. 60/522,541, filed on Oct. 12, 2004, provisional application No. 60/390,925, filed on Jun. 24, 2002.

(51) Int. Cl.
*E21B 29/00* (2006.01)

(52) U.S. Cl. ..... 166/297; 166/298; 166/242.5

(58) Field of Classification Search ..... 166/297, 166/298, 242.3, 242.5, 242.1, 317
See application file for complete search history.

(56) References Cited

U.S. PATENT DOCUMENTS

| | | | | |
|---|---|---|---|---|
| 3,994,339 | A * | 11/1976 | Goode et al. | 166/117.5 |
| 4,460,046 | A | 7/1984 | Pringle | |
| 5,361,843 | A | 11/1994 | Shy | |
| 5,390,742 | A | 2/1995 | Dines | |
| 6,973,970 | B2 | 12/2005 | Johnston et al. | |
| 2003/0234104 | A1 | 12/2003 | Johnston | |

FOREIGN PATENT DOCUMENTS

| | | |
|---|---|---|
| GB | 2302110 A | 1/1991 |
| GB | 2302110 | 8/1997 |

* cited by examiner

*Primary Examiner*—Jennifer H Gay
*Assistant Examiner*—David Andrews
(74) *Attorney, Agent, or Firm*—Trop, Pruner & Hu, P.C.; Jeremy P. Welch; James L. Kurka

(57) ABSTRACT

A fluid communication nipple including a tubular mandrel having an interior surface defining an internal bore and a passageway extending substantially lengthwise along a portion of the mandrel. The passageway is defined by an exterior wall section and an interior wall section, wherein the interior wall section extends outward from the interior surface into the bore. When it is desired to establish fluid communication through the passageway between the exterior and interior of the nipple an opening is formed through the internal wall section.

15 Claims, 1 Drawing Sheet

FLUID COMMUNICATION NIPPLE HAVING AN INTERIOR PASSAGEWAY WITH AN INTERIOR WALL SECTION THAT MAY BE OPENED TO ESTABLISH FLUID COMMUNICATION WITH THE PASSAGEWAY

RELATED APPLICATIONS

This application claims the benefit of U.S. Provisional Patent Application No. 60/522,541 filed on Oct. 12, 2004, and is a continuation-in-part of U.S. patent application Ser. No. 10/460,546, entitled "APPARATUS AND METHODS FOR ESTABLISHING SECONDARY HYDRAULICS IN A DOWNHOLE TOOL," which was filed on Jun. 12, 2003, now U.S. Pat. No. 6,973,970, which granted on Dec. 13, 2005, and which claims the benefit of Provisional Patent Application Ser. No. 60/390,925, which was filed on Jun. 24, 2002.

FIELD OF THE INVENTION

The present invention relates in general to downhole well tools and more specifically to a fluid communication nipple for communicating fluid flow from outside of the nipple to the inside of the nipple when communication is desired.

BACKGROUND

It is often desired to provide radial fluid communication between the exterior of a well tool to an interior of a well tool. Prior art drilling operations commonly include well tools that have a passageway for establishing fluid communication radially through the tool at a time after installation in the well. These tools typically include a plug blocking communication through the passageway, elastomer and/or metal-to-metal seals, and a sliding sleeve or other moveable mechanism for dislodging the plug to establish fluid communication.

Drawbacks to the prior art devices include, without limitation, loss of sealing of the passageway permitting fluid communication when not desired through failure of the seals and/or inadvertent dislodging of the plugging device. Additionally these devices include numerous elements increasing the cost and the chance of failure of the device to operate as intended.

Therefore, it is a desire to provide a fluid communication nipple for communicating fluid from outside a well tool to the inside of a well tool through a passageway that addresses drawbacks of the prior art devices. It is a still further desire to provide a fluid communication nipple that does not require elastomer or metal-to-metal seals to prevent fluid communication through the passageway. It is a still further desire to provide a fluid communication nipple that alleviates unintended establishment of fluid communication through the passageway. It is a still further desire to provide a fluid communication nipple that provides establishment of fluid communication without compromising the integrity of the nipple. It is a still further desire to provide a fluid communication nipple that is efficient, reliable and eliminates moving elements.

SUMMARY OF THE INVENTION

In view of the foregoing and other considerations, the present invention relates in general to establishing operating or controlling fluid flow to a subsurface well tool and more specifically to providing a mechanism and method of selectively providing fluid communication between and exterior and an interior of a fluid communication nipple when desired.

Accordingly, a device and method for establishing fluid communication radially between the exterior of a well tool and the interior of a well tool is provided. The fluid communication device may be installed in a wellbore and remain dormant in a non-communicating state until radial fluid communication is desired.

In one embodiment of the presenting invention, a fluid communication nipple includes a tubular mandrel having an interior surface defining an internal bore and a passageway extending substantially lengthwise along a portion of the mandrel. The passageway is defined by an exterior wall section and an interior wall section, wherein the interior wall section extends outward from the interior surface into the bore. When it is desired to establish fluid communication through the passageway between the exterior and interior of the nipple an opening is formed through the internal wall section.

A port into the passageway may be formed exterior of the mandrel adapted for connecting a fluid conduit. The passageway may extend substantially along a straight path along a portion of the length of the mandrel. The path of the passageway may be curved.

In one embodiment of the present invention the fluid communication nipple does not utilize seals, elastomer or metal-to-metal, to maintain the passageway closed and in a non-communicating state. The device of the present invention may not include any moving elements in connection with the mandrel for forming an opening to establish fluid communication through the passageway.

An embodiment of a method of establishing radial fluid communication between the exterior of a well tool and an interior of a well tool includes the steps of providing a tubular mandrel having an interior surface defining an internal bore and providing a passageway extending substantially lengthwise along a portion of the mandrel, wherein the passageway is defined by an exterior wall section and an interior wall section. The interior wall section extends outward from the interior surface into the bore. The passageway is closed and fluid communication is blocked through the passageway. Connecting the mandrel within a tubular string and disposing the tubular string carrying the mandrel in a wellbore. Creating an opening through the interior wall section providing fluid communication between the exterior of the mandrel and the interior of the mandrel through the passageway.

Various opening tools including, but not limited to, mechanical, abrasive and chemical cutters may be utilized for creating the opening through the interior wall section into the passage. The opening tool may be run into the bore via tubing, slickline, wireline or other known means for conveyance. An example of an opening tool is taught in U.S. Patent Application Publication 2003/0234104 A1 by common applicant Schlumberger, which is incorporated herein by reference for all purposes.

A fluid conduit may be connected to the passageway from an exterior of the mandrel. Another well tool may be positioned in operational connection with the opening formed through the interior wall section into the passageway. Fluid may flow from the conduit through the passageway to the other well tool.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
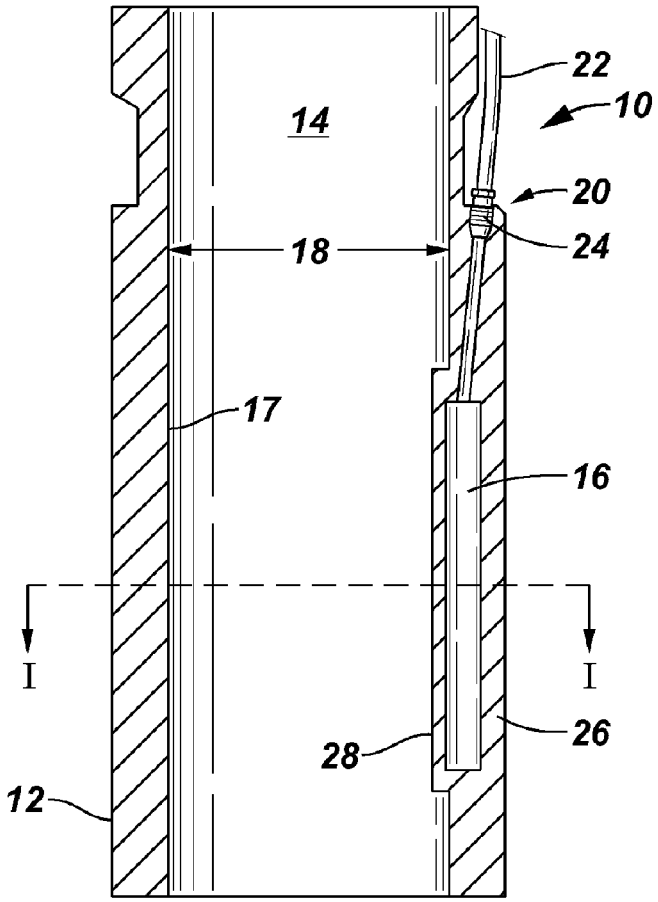
FIG. 1 is a cross-sectional side view of an embodiment of a fluid communication nipple of the present invention.

Refer now to the drawings wherein depicted elements are not necessarily shown to scale and wherein like or similar elements are designated by the same reference numeral through the several views.

FIG. 1 is a side, cross-sectional view of an embodiment of a fluid communication nipple of the present invention, generally denoted by the numeral 10. Nipple 10 includes a tubular mandrel 12 and a passageway 16 that extends longitudinally through at least a portion of mandrel 12. Nipple 10 is also referred to in the art as a sub. It should be recognized that nipple 10 may be a component of a well tool and or a mechanism that may be utilized in conjunction with a well tool. Examples of use of the present invention include, but are not limited to, subsurface safety valves, chemical injection, release of packers and release of annulus hydrostatic pressure during de-completion.

Mandrel 12 has an interior surface 17 having an internal diameter 18 that defines an internal bore 14 of nipple 10. Nipple 10 is connected within a tubular, casing or tubing, string (not shown) when the string is installed in the well. Bore 14 is in fluid communication with the bore of the tubular string for carrying production and/or injection fluids between the surface and the subsurface formations. Passageway 16 is closed preventing fluid flow between the interior and exterior of nipple until fluid communication is desired and intentionally established.

Passageway 16 is provided for communicating a fluid from the exterior of nipple 10 to a well tool (not shown) positioned within the tubular string by activating passageway 16. Passageway 16 runs substantially longitudinally or lengthwise along at least a portion of the length of mandrel 12. Passageway 16 may extend substantially along a straight or a curved path.

Passageway 16 further includes at least one port 20 adapted for connecting a fluid conduit 22. For example, fluid conduit may be a control line for carrying fluid between the surface and a subsurface safety valve for operating the safety valve. In another example, fluid conduit line 22 may provide chemicals to an injection sub installed in the tubular string. Port 20 may include a connector 24 of a type for connecting a desired fluid conduit 22 as is well known in the art. Port 22 may be open, for example, to the annulus or to another flow path to allow fluid communication within the tool to release pressure or equalize pressures.

When nipple 10 is in the closed or unactivated state as shown in FIG. 1, fluid communication is blocked through passageway 16 between bore 14 and the exterior of nipple 10. Nipple 10 may remain dormant in the closed state until it is desired to establish fluid communication with another well tool. In order to establish fluid communication through passageway 16 into bore 14 an opening must be formed into passageway 16.

Figure 2:
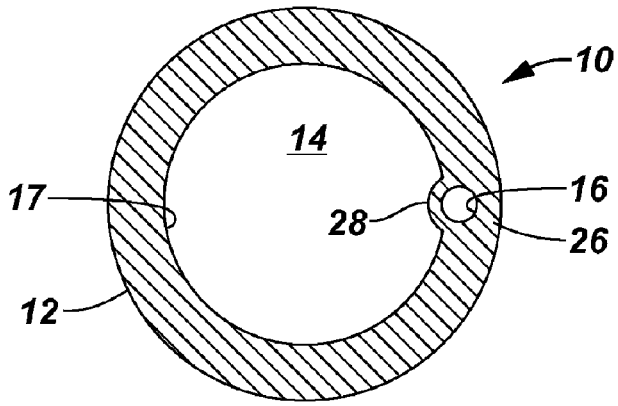
FIG. 2 is a cross-sectional side view of the fluid communication nipple along the line I-I of FIG. 1.

With reference to FIGS. 1 and 2, passageway 16 is formed longitudinally along a portion of the length of mandrel 12. Passageway 16 is defined by an exterior wall section 26 and internal wall section 28. Internal wall section 28 extends radially outward from interior surface 17 into bore 14. Desirably, internal wall section 28 does not extend beyond the nominal internal diameter of mandrel 12. Internal wall section 28 provides a structure for creating an opening to establish fluid communication with passageway 16.

When it is desired to establish fluid communication through passageway 16 an opening tool, such a mechanical, abrasive or chemical cutter, is run into bore 14 of nipple 10. An example of a desired and acceptable opening tool is described and taught in U.S. Patent Application Publication 2003/0234104 A1 by common applicant Schlumberger, which is incorporated herein by reference for all purposes.

Fluid communication nipple 10 of the present invention provides a novel and improved tool and system for selectively establishing fluid communication with a well tool or system after the initial installation of nipple 10. Novel fluid communication nipple 10 facilitates establishing the desired fluid communication without compromising the integrity of mandrel 12. Nipple 10 of the present invention provides a mechanism for establishing fluid communication at a desired time while maintaining non-fluid communication integrity radially between bore 14 and the exterior of nipple 10. The closed or unactivated state does not require elastomeric or metal-to-metal seals. Further, the present invention alleviates the concerns of unintentionally creating fluid communication through passageway 16 when running other tools or performing operations through bore 14.

A method of using a fluid communication nipple 10 of the present invention includes the steps of providing a tubular mandrel 12 having an internal diameter 18 forming a bore 14, and providing a passageway 16 extending longitudinally through at least a portion of mandrel 12 defined by an and exterior wall section 26 and an interior wall section 28. Interior wall section 28 extends radially into bore 14, outward from interior surface 17, wherein passageway 16 is closed to fluid communication therethrough. Installing tubular mandrel 12 in a tubular string and disposing the tubular string within a wellbore. Establishing fluid communication between bore 14 and passageway 16 through internal wall section 28. Communicating a fluid through passageway 16 between the exterior of mandrel 12 and bore 14.

From the foregoing detailed description of specific embodiments of the invention, it should be apparent that a fluid communication nipple and method that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications including, but not limited to, those implementation variations which may have been suggested herein, may be made to the disclosed embodiments without departing from the spirit and scope of the invention as defined by the appended claims which follow.

What is claimed is:

1. A fluid communication nipple for establishing radial fluid communication between the outside of the nipple and the inside of the nipple, the nipple comprising:

a tubular mandrel having an internal bore;

a passageway extending substantially lengthwise along a portion of the mandrel, the passageway defined by an exterior wall section and an interior wall section, the interior wall section comprising a protuberance that extends into the internal bore in a transverse cross-section of the mandrel and terminating in a closed chamber; and a connector disposed on the exterior of the mandrel to engage an end of a tubing to establish fluid communication between the tubing and the closed chamber, wherein the fluid communication is established between the tubing and the internal bore by breaching the interior wall section.

2. The nipple of claim 1, wherein the nipple does not include any moving parts.

3. The nipple of claim 2, wherein the passageway runs in a substantially straight path along at least a portion of the longitudinal length of the mandrel.

4. The nipple of claim 2, wherein the passageway runs in a substantially curved path along at least a portion of the longitudinal length of the mandrel.

5. The nipple of claim 1, wherein the nipple does not include any elastomer or metal-to-metal seals.

6. The nipple of claim 5, wherein the passageway runs in a substantially straight path along at least a portion of the longitudinal length of the mandrel.

7. The nipple of claim 5, wherein the passageway runs in a substantially curved path along at least a portion of the longitudinal length of the mandrel.

8. The nipple of claim 1, wherein the passageway runs in a substantially straight path along at least a portion of the longitudinal length of the mandrel.

9. The nipple of claim 1, wherein the passageway runs in a substantially curved path along at least a portion of the longitudinal length of the mandrel.

10. The nipple of claim 1, wherein the protuberance comprises a convex surface exposed to the internal bore.

11. A method of establishing radial fluid communication between the exterior of a well tool and an interior of a well tool, the method comprising:

providing a tubular mandrel having an internal bore;

providing a passageway extending substantially lengthwise along a portion of the mandrel, the passageway defined by an exterior wall section and an interior wall section, the interior wall section comprising a protuberance that extends into the internal bore in a transverse cross-section of the mandrel, wherein fluid communication through the passageway is closed;

connecting the mandrel within a tubular string;

disposing the tubular string carrying the mandrel in a wellbore; and creating an opening through the interior wall section providing fluid communication between the exterior of the mandrel and the interior of the mandrel through the passageway.

12. The method of claim 11, wherein fluid communication is closed without use of an elastomer or metal-to-metal seal.

13. The method of claim 11, further including the step of: connecting a fluid conduit exterior of the mandrel to the passageway.

14. The method of claim 11, wherein the passageway runs in a substantially curved path along at least a portion of the longitudinal length of the mandrel.

15. The method of claim 11, wherein the protuberance comprises a convex surface exposed to the internal bore.

* * * * *